US009271576B2

(12) United States Patent
Loney

(10) Patent No.: US 9,271,576 B2
(45) Date of Patent: Mar. 1, 2016

(54) SELF-ALIGNING, COMPACTABLE CHAIR

(71) Applicant: Christopher Loney, Virginia Beach, VA (US)

(72) Inventor: Christopher Loney, Virginia Beach, VA (US)

( * ) Notice: Subject to any disclaimer, the term of this patent is extended or adjusted under 35 U.S.C. 154(b) by 0 days.

(21) Appl. No.: 14/562,680

(22) Filed: Dec. 6, 2014

(65) Prior Publication Data

US 2015/0091336 A1 Apr. 2, 2015

Related U.S. Application Data

(63) Continuation-in-part of application No. 13/595,249, filed on Aug. 27, 2012, now abandoned.

(51) Int. Cl.

| | |
|---|---|
| ***A47C 4/48*** | (2006.01) |
| ***A47C 4/00*** | (2006.01) |
| ***A47C 1/14*** | (2006.01) |

(52) U.S. Cl.
CPC .. *A47C 4/00* (2013.01); *A47C 1/146* (2013.01)

(58) Field of Classification Search
CPC ..... A47C 4/286; A47C 1/146; A47C 5/10; A47C 9/10; A47C 4/42
USPC ..... 297/16.1, 16.2, 19, 24, 29, 42, 45
See application file for complete search history.

(56) References Cited

U.S. PATENT DOCUMENTS

| | | | | |
|---|---|---|---|---|
| 8,002,349 | B1 * | 8/2011 | Pizzuto | A47C 1/143 297/184.11 |
| 8,056,982 | B2 * | 11/2011 | Loney | A47C 1/146 297/16.2 |

* cited by examiner

*Primary Examiner* — Sarah McPartlin
(74) *Attorney, Agent, or Firm* — William G. Sykes

(57) ABSTRACT

A self-aligning, compactable, collapsible seating structure formed by sections of hollow tubing, each hollow tubing component has a first end having a first diameter and a second opposing region having a second, reduced diameter. Reduced diameter regions are insertable into said tubing regions having a first diameter to form a self-aligning joint. A pair of rigid, U-shape frames are rotatively connected together to form an A-frame shaped support. Dimensions of the chair in an operational, deployed configuration may be reduced along two dimensions (i.e., height, length) into a compacted configuration for storage or transport. The novel chair may be compacted into a thin bundle that may be rolled up in and contained within fabric that forms a portion of the chair. In its compacted, rolled up state, the novel chair is suitable for transportation within a backpack or other such enclosure.

5 Claims, 8 Drawing Sheets

SELF-ALIGNING, COMPACTABLE CHAIR

RELATED APPLICATIONS

This application is a Continuation-in-Part Application of U.S. patent application Ser. No. 13/595,249 Self-Aligning, Compactable Chair filed August 27, 2012 that is included herein in its entirety by reference.

FIELD OF THE INVENTION

The invention pertains to collapsible seating structures and, more particularly, to a chair having a light-weight rigid, collapsible frame having reduced dimensions in a collapsed state allowing the compacted, collapsed chair to be carried in a back pack or rolled up and secured without the necessity of a bag.

BACKGROUND OF THE INVENTION

Many outdoor activities are greatly enhanced by the use of a portable seat or back support structure. Many such devices have been proposed in the prior art, all suffer from the limitations of bulk and/or weight. While many prior art structures may be folded or collapsed for transportation or storage, the rigid frames thereof typically retain at least one of their original dimensions. Consequently, the frame dimensions of such prior art chairs or seats, even in the folded or collapsed configuration are not reduced and the degree of compaction of such structures is thereby limited. In other words, when such prior art seats are folded or collapsed, they typically retain at least two (e.g., height and width), of their open, operational dimensions. When the activity for which a seat or backrest is required occurs a distance from a transportation source, the collapsed dimensions of prior art structures still present logistical problems due to their bulk when hand carrying them to the site of the activity.

DISCUSSION OF THE RELATED ART

Several attempts at providing portable and/or collapsible seating or backrest structures may be found in the prior art. For example, U.S. Pat. No. 1,799,939 for CONVERTIBLE GROUND SEAT AND LOUNGE, issued Apr. 7, 1931 to Claude Beauchamp Wainewright et al. discloses a portable seating structure collapsible along a single dimension.

U.S. Pat. No. 2,570,571 for COMBINATION BACK REST AND BAG STRUCTURE, issued Oct. 9, 1951 to Robert N. Leeman teaches another portable seating arrangement collapsible along a single dimension.

U.S. Pat. No. 2,816,599 for COMBINATION SUPPORT AND BAG, issued Dec. 17, 1957 to Marjory M. Adams discloses another seat/backrest structure collapsible along a single dimension and having a carrying bag which, in addition to facilitating carrying the ADAMS seat, functions as seat and back support surfaces.

U.S. Pat. No. 4,736,825 for COMBINATION TOTE BAG AND BODY REST, issued Apr. 12, 1988 to Daniel P. Belfi shows another structure collapsible in a single dimension and including an integral tote bag.

U.S. Pat. No. 4,530,451 for COMBINATION BACK PACK/BEACH CHAIR, issued Jul. 23, 1985 to James Hamilton discloses a seat/back rest structure collapsible along a single dimension and having integral straps to facilitate carrying the device on one's back.

U.S. Pat. No. 5,042,874 for FOLDING BEACH LOUNGE, issued Aug. 27, 1991 to Daniel E. Williams teaches another portable seating device collapsible along a single dimension. Extendable portions may be withdrawn to collapse the WILLIAMS device to a predetermined size rectangular parallelepiped, thereby lowering the height as well as the thickness of the lounge, consequently actually allowing compression of structure size along two dimensions.

U.S. Pat. No. 5, 701,979 for BAG THAT MAY BE CONVERTED INTO A FOLDING BACK REST FOR THE BEACH OR PARK, issued Dec. 30, 1997 to Jan Harriett Voich teaches a folding structure that may be contacted into an integral carrying bag. However, the structure collapses only along a single dimension.

Published U.S. patent application No. 2004/0195891 for GROUND LOUNGER, published Oct. 7, 2004 upon application by Clifford Eugene Vaughan, provides yet another folding structure, collapsible along a single dimension U.S. Pat. No. 6,902,230 for FOLDABLE CHILD SUPPORT DEVICE, issued Jun. 7, 2005 to Shun-Min Chen, provides a structure having frame members foldable at a mid-point thereof so as to compact the structure along both height and a length dimensions.

None of the patents and published patent application, taken singly, or in any combination are seen to teach or suggest the novel Self-Aligning, Compactable Chair of the present invention.

SUMMARY OF THE INVENTION

In accordance with the present invention there is provided a self-aligning, compactable, collapsible seating structure wherein dimensions of the chair in an operational, deployed configuration may be reduced along two dimensions (i.e., height, length) into a compacted configuration for storage or transport. The novel chair may be compacted into a thin bundle that may be rolled up in and contained within fabric that forms a portion of the chair. In its compacted, rolled up state, the novel chair is suitable for transportation within a backpack or other such enclosure.

It is, therefore, an object of the invention to provide a seating structure convertible from an operational, deployed configuration to a collapsed configuration.

It is another object of the invention to provide a seating structure convertible from an operational configuration to a collapsed configuration wherein both height and length are reduced in the transformation It is an additional object of the invention to provide a seating structure having a rigid frame that converts from an open, operational configuration to a collapsed configuration.

It is an additional object of the invention to provide a seating structure having a rigid frame that is convertible from an operational configuration to a collapsed configuration the frame having no moving parts such as hinged joints or slides.

It is a further object of the invention to provide a seating structure convertible from an operational configuration to a collapsed configuration having a seat supporting portion and a back-supporting portion, an angle therebetween being selectively adjustable.

It is a still further object of the invention to provide a seating structure convertible from an operational configuration to a collapsed configuration having a moisture proof mat portion, when in a collapsed configuration, the seating structure may be rolled up within the mat portion.

It is yet another object of the invention to provide a seating structure convertible from an operational configuration to a collapsed configuration having frame members without foldable mid-point joints, the frame members being held in a locked configuration by an elastic band inside the frame member tubing with the frame member tubing being held together with male-female connections and connectable ends with expanded and reduced sizes and with a friction fit to form an extended portion.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a self-aligning, compactable, collapsible chair structure having a seat-supporting portion and a back-supporting portion both rotatably connected to a common top member, the angle therebetween being adjustable.

Figure 1:
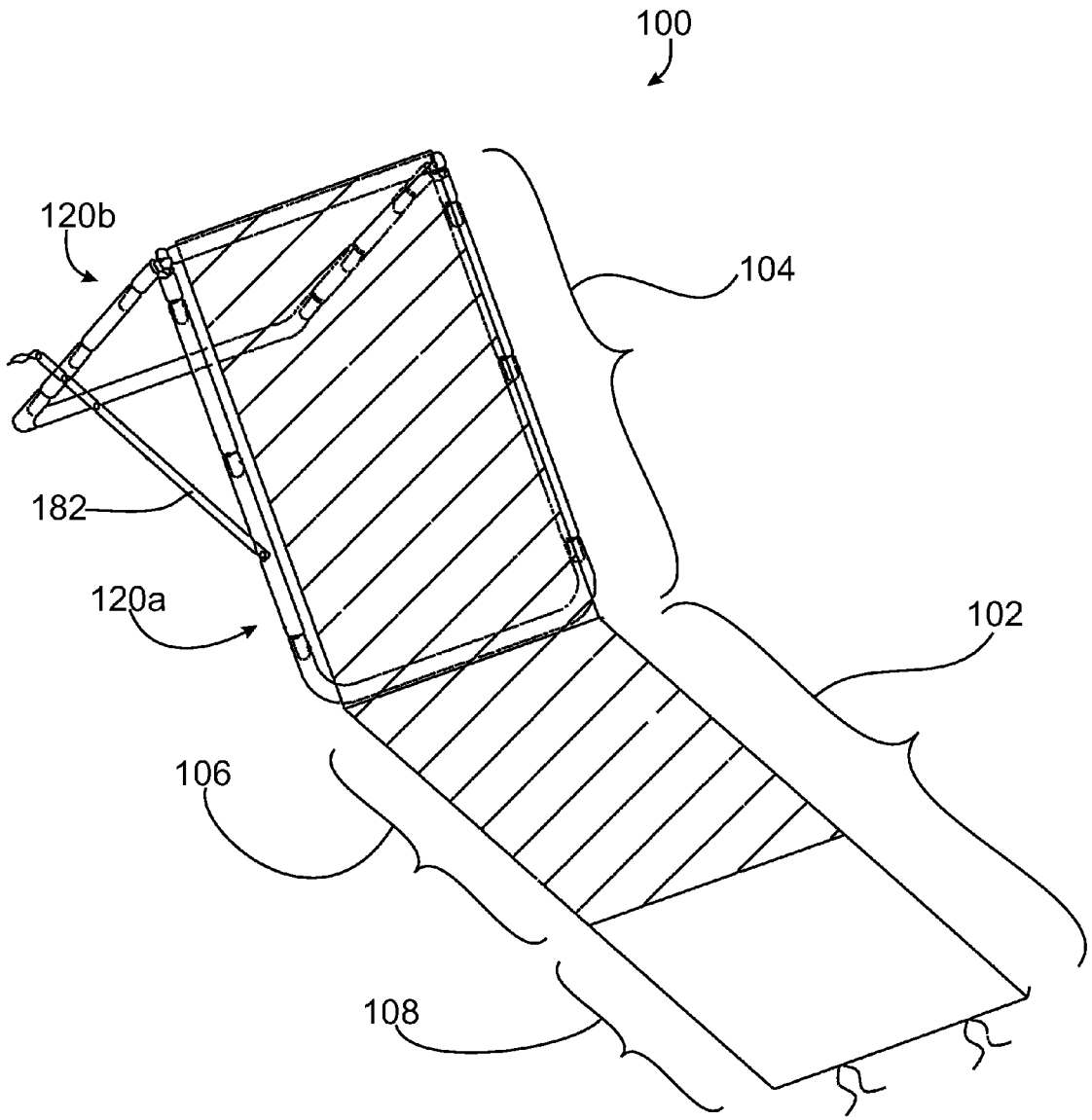
FIG. 1 is an isometric schematic view of the self-aligning, compactable, collapsible chair of the present invention in an open, operational configuration.

Referring first to FIG. 1, there is shown an isometric schematic view of the self-aligning, compactable, collapsible chair of the present invention in an open, operational configuration, generally at reference number 100.

Chair 100 has a seat/leg-supporting portion 102 consisting of a seat-supporting region 106 and a leg-protecting region 108.

A back supporting region 104 is provided by a first ridged, collapsible U-shaped frame 120A that is hingedly connected to a second rigid, collapsible U-shaped frame 120B that supports first rigid, collapsible U-shaped frame 120A at a desired inclination by use of a flexible strap 182 interconnecting first rigid, collapsible U-shaped frame 120A to second rigid, collapsible U-shaped frame 120B.

Figure 2A:
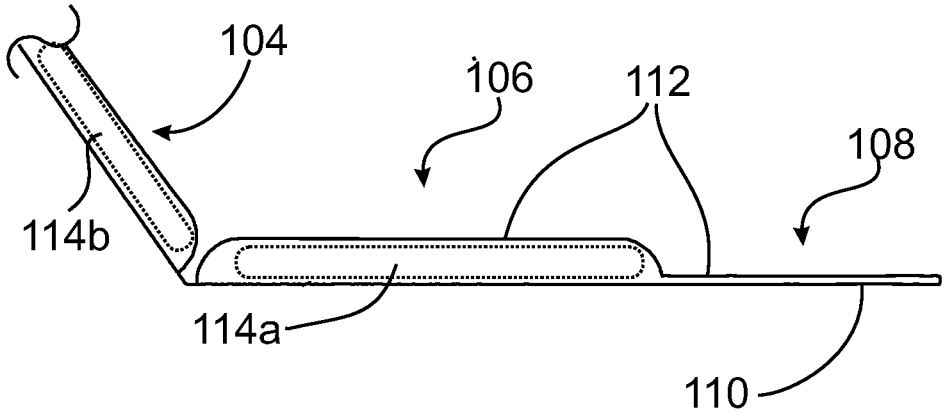
FIG. 2A is side, cross-sectional, elevational, schematic views of a first embodiment of a seat/leg supporting region of the collapsible chair of FIG. 1.
Figure 2B:
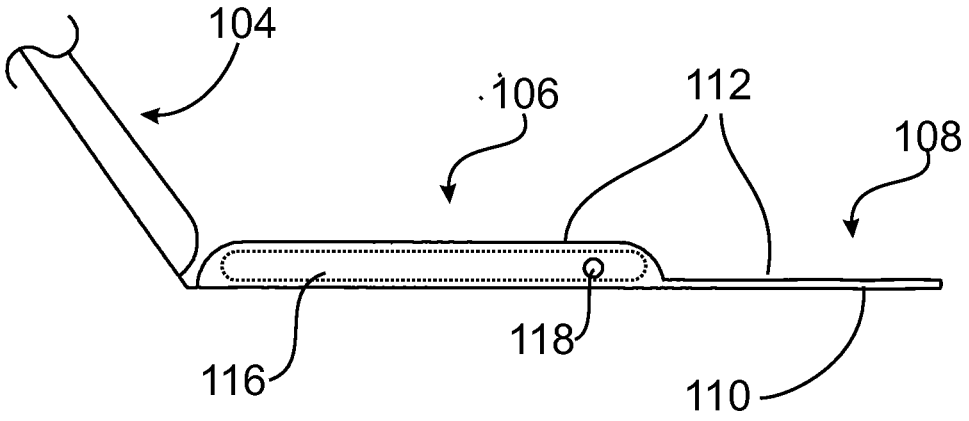
FIG. 2B is side, cross-sectional, elevational, schematic views of a second embodiment of a seat/leg supporting region of the collapsible chair of FIG. 1.

Referring now also to FIGS. 2A and 2B, there are shown side, cross-sectional, elevational, schematic views of two embodiments of seat/leg supporting region 102 of seat 100.

As seen in FIG. 2A, seat-supporting region 106 is typically a padded structure with a moisture barrier, 110 forming a lower, ground-engaging surface. A wear-resistant membrane 112 forms an upper surface of both leg-protecting region 108 and seat supporting region 106. In a first embodiment, a back supporting region formed by first rigid, collapsible U-shaped frame 120A and supporting region 106 have foam pads 114*a*, 114*b* disposed between water-resistant membrane 110 and wear-resistant membrane 112. It will be recognized that foam pads 114*a*, 114*b* may be implemented as a continuous single foam pad. While foam pads 114*a*, 114*b* have been chosen for purposes of disclosure, it will be recognized by those of skill in the art that many alternate materials may be substituted therefor. Consequently, the invention is not considered limited to the foam pad 114*a* chosen for purposes of disclosure. Rather, the invention comprehends any and all suitable padding materials.

It will be further recognized that while a two-ply structure consisting of moisture resistant membrane 110 and wear-resistant membrane 112 has been shown, a single-ply structure may readily be substituted therefore.

As seen in FIG. 2B, an inflatable bladder 116 and an inflation tube and valve 118 replace foam pad 114 of FIG. 2A. The use of an inflatable bladder 116 allows chair 100 to possibly be compacted to a smaller volume than in the embodiment of FIG. 2*a* having foam pad 114. Further, inflatable bladder 116 allows a user to adjust a degree of firmness or support of the "padding" provided thereby to a personal preference. Inflatable bladders 116 and inflation tubes and valve structures 118 are considered to be well known to those of skill in the art and are not further described herein.

A back-supporting portion 104 is attached to seat/leg supporting region 102 by a continuation of at least wear resistant membrane 110 or wear resistant member 112.

Figure 3:
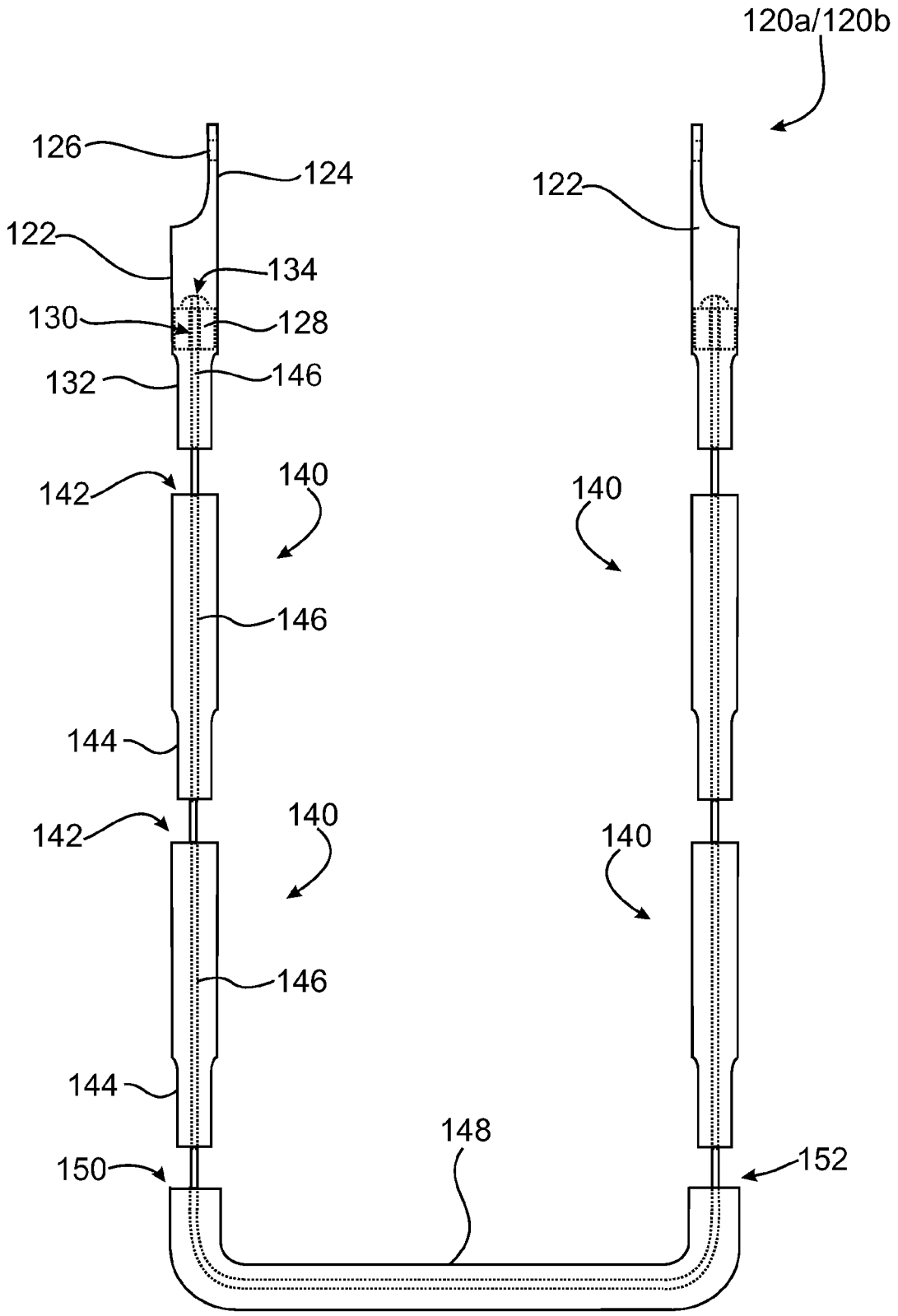
FIG. 3 is an exploded, front elevational, schematic view of collapsible, U-shaped frame forming a part of the collapsible chair of FIG. 1.

Referring now to FIG. 3, there is shown an exploded, front elevational, schematic view of collapsible, U-shaped frames 120*a* and 120*b*. Frame 120*a* defines and supports back-supporting portion 104 of chair 100.

Frames 120*a*/120*b* each have a pair of upper frame braces 122. Upper frame brace 122 has a major axis, not specifically identified, and an upper flattened region 124 having a through hole 126 disposed in flattened region 124 perpendicularly the major axis.

Upper frame brace 122 has reduced diameter lower portion 132. An elastic cord retaining member 128 is disposed within upper frame brace 122 and retained therein by the diameter reduction proximate reduced diameter lower portion 132.

Elastic cord retaining member 128 has a central through hole 130 disposed parallel to the major axis and sized to accept an elastic cord 146 therethrough.

An end, not specifically identified, of elastic cord 146 is retained above elastic core retaining member by a knot, a fastener, cement, or any other suitable manner, shown schematically at reference number 134, that keeps the end of elastic cord 146 from passing through hole 130 once secured.

Rigid, collapsible, U-shaped frames 120*a*, 120*b* each typically have four hollow tubular frame members 140. Tubular member 140 has an upper end 142 having a first diameter, and a reduced diameter region 144. The first diameter at upper end 142 being sized to receive and frictionally retain the reduced diameter portion 132 of upper frame brace 122 or a reduced diameter region 144 of another hollow tubular frame members 140.

A U-shape bottom member 148 has a pair of opposed ends 150 and 152, each having a diameter sized to accommodate and frictionally retain a reduced diameter region 132 of upper frame brace 122 or reduced diameter region 144 of hollow tubular frame member 140.

Frame members 122, 140, and 148 are formed from lightweight, ductile metal, typically aluminum. Joints formed by inserting a reduced diameter region (e.g., 132, and 140) into a larger diameter portion of tubing (e.g., 142, 150, 152) forms self-aligning joints. Self-alignment in ensured by forming frame components so that the length of regions of reduced diameter is sufficient to cause the joint formed to be self-aligning.

Figure 4A:
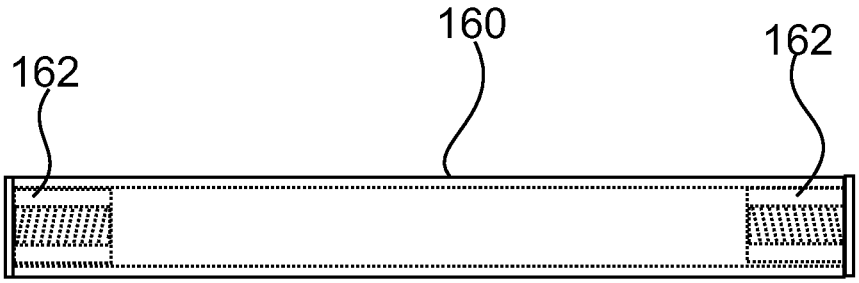
FIG. 4A is shown a side elevational, schematic view of a top member frame member forming a part of the collapsible chair of FIG. 1.

Referring now also to FIG. 4A, there is shown a side elevational, schematic view of a top frame member 160. Top frame member 160 is a straight tubular structure having a pair of opposing ends, not specifically identified, each receiving and retaining a plastic insert 162.

Figure 4B:
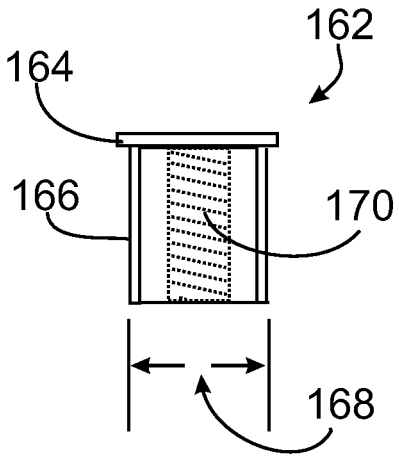
FIGS. 4B-4D are a side elevational, a top plan, and a bottom plan, schematic view, respectively, of a plastic insert forming a part of the top frame member of FIG. 4A.
Figure 4C:
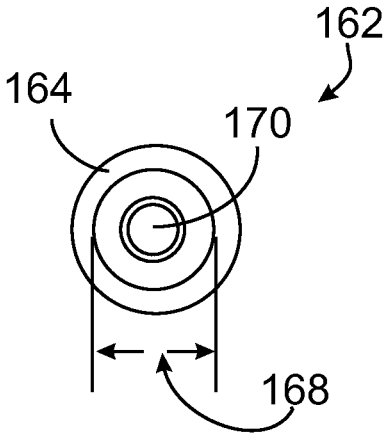
Figure 4D:
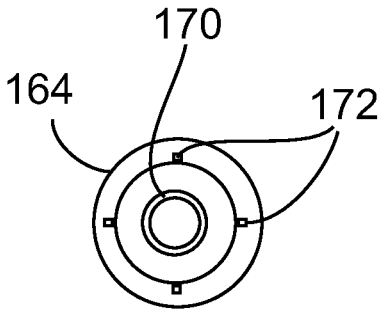

Referring now to FIGS. 4B-4D, there are shown a side elevational, a top plan, and a bottom plan, schematic view, respectively, of plastic insert 162. Plastic insert 162 has a flange 164 having a larger diameter that the diameter of top member 160. A body 166 having a diameter 168 depends from a lower surface of flange 164. Body 166 is adapted for insertion in the ends of top member 160.

Plastic insert 164 has a threaded bore 170 extending along the entire height thereof.

Protrusions 172 spaced circumferentially around body 166 are adapted to press against an inside surface of top frame member 160 as a screw 174 (best seen in FIG. 5) is inserted into threaded bore 170 and thereby slightly expanding the diameter 168 of body 166 and retaining plastic insert 162 within top frame member 160.

Figure 5:
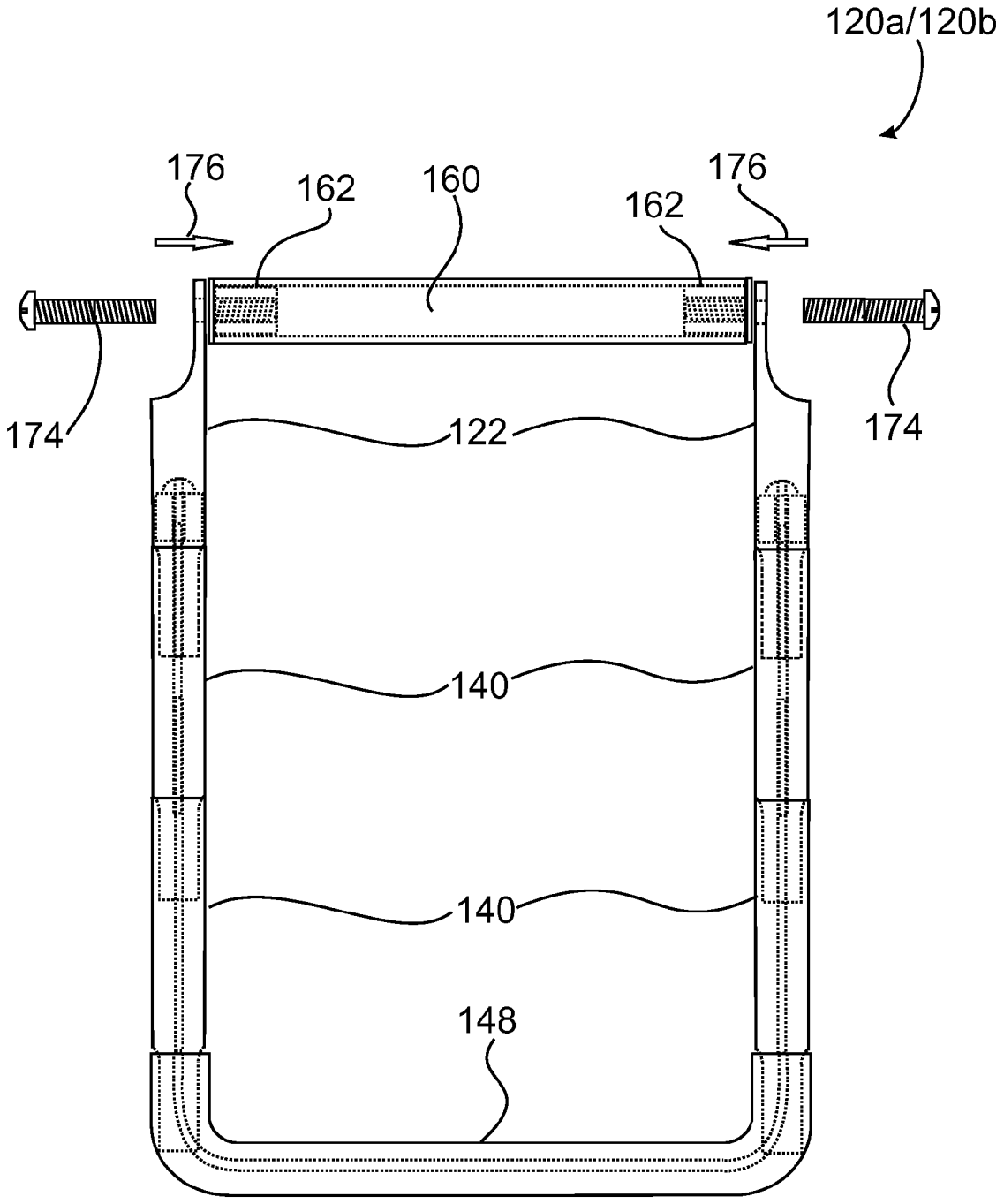
FIG. 5 is a front elevational, schematic view of collapsible, U-shaped frame of FIG. 3 connected to the top frame member of FIG. 4A.

Referring now also to FIG. 5, there is shown front elevational, schematic view of collapsible, U-shaped frames 120*a* and 120*b* connected to a top frame member 160. In FIG. 5, the frame components shown in FIG. 3 in an exploded view are joined to form frames 120*a*, 120*b* in their respective operational configurations.

Top frame member 160 is shown in its operational position between flattened regions 124 of upper frame braces 122. Plastic inserts 162 in each end of top frame member 160, more specifically, threaded through hole 170 of plastic insert 162 is show positioned to receive screws 174 that will be inserted through holes 126 in the directions shown by respective arrows 176 adjacent each end of top frame member 160.

Figure 6:
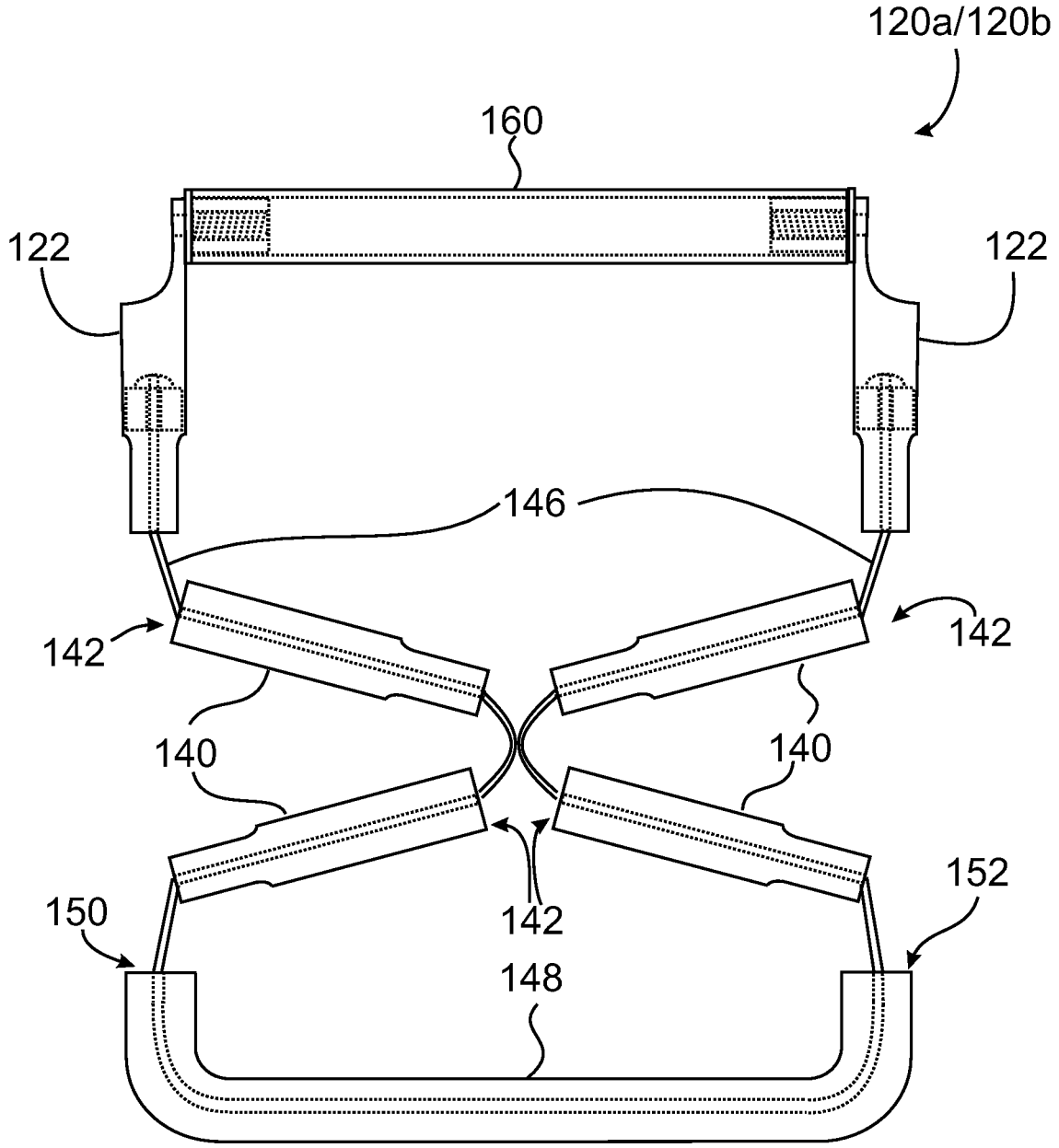
FIG. 6 is a front elevational, schematic view of U-shaped, collapsible support frames of FIG. 3 in a partially collapsed state.

Referring now also to FIGS. 6, there is shown a front elevational, schematic view of U-shaped, collapsible support frames 120*a*, 120*b* in a partially collapsed state. The reduced diameter regions 132 of upper frame braces 122 and the reduced diameter regions 144 of frame hollow tubular pieces 140 have been withdrawn from respective upper ends 142 of hollow tubular pieces 140 and ends 150, 152 of U-shaped bottom frame member 148.

Figure 7:
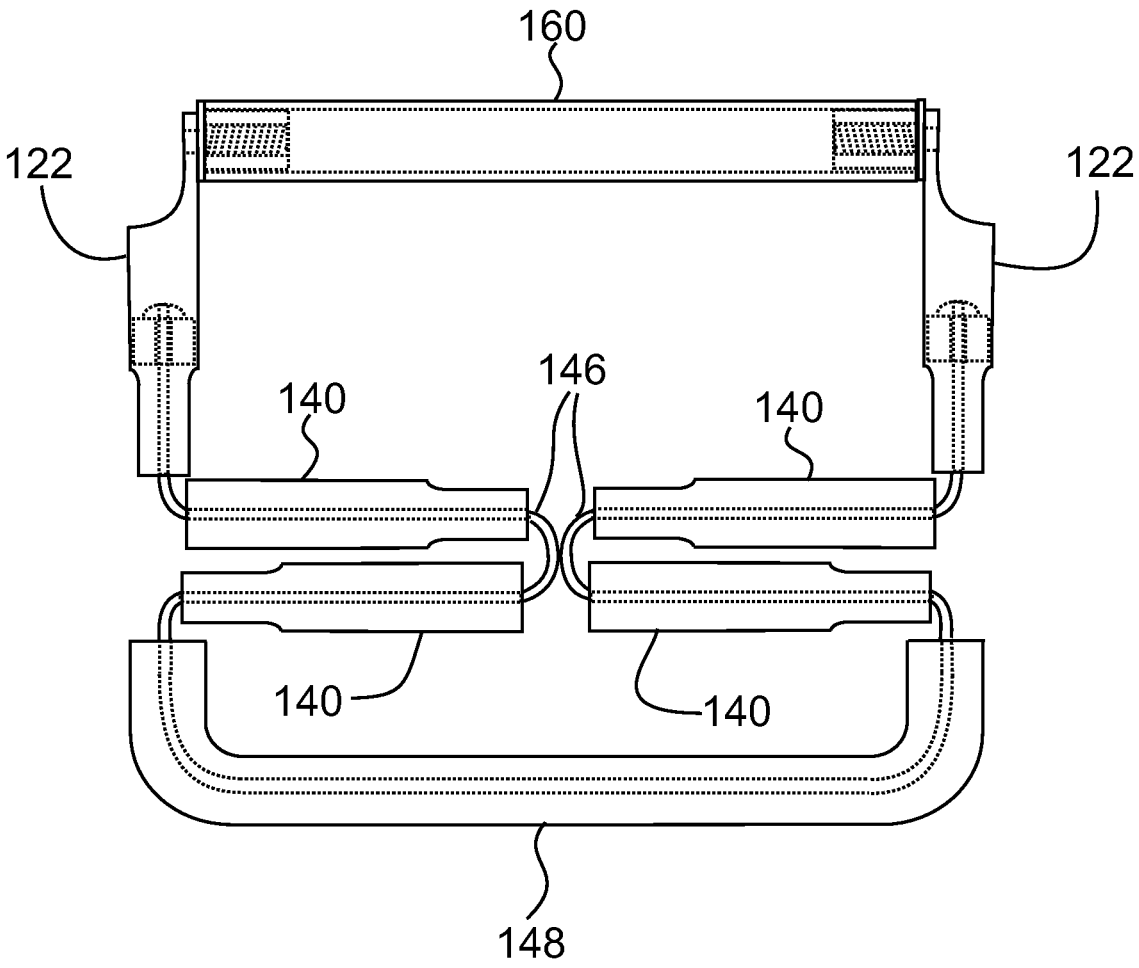
FIG. 7 is a front elevational, schematic view of U-shaped, collapsible support frames of FIG. 3 in a completely collapsed state.

Referring now also to FIG. 7, the partially collapsed frames 120*a*, 120*b* of FIG. 6 are now shown in a completely collapsed arrangement. The four hollow tubular frame pieces 140 all now lie substantially parallel to top frame member 160 in two rows, and bottom frame member 148 has moved inwardly toward top frame member 160 adjacent a bottom row of hollow frame tubular pieces 140. Once compacted, the frames 120*a*, 120*b* may be rolled up in the moisture proof barrier 110 (FIGS. 2*a*, 2*b*) into a configuration suitable for carrying in a backpack or other such container.

Figure 8A:
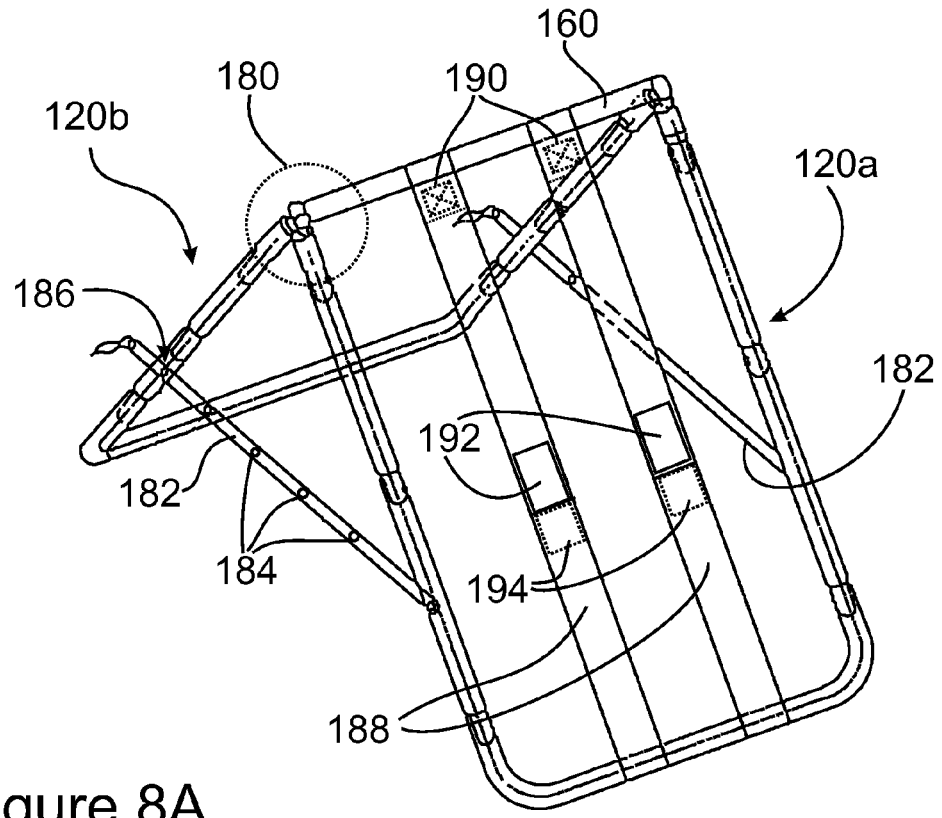
FIG. 8A is a perspective, schematic view of U-shaped collapsible support frames of FIG. 3 assembled into an A-frame structure.
Figure 8B:
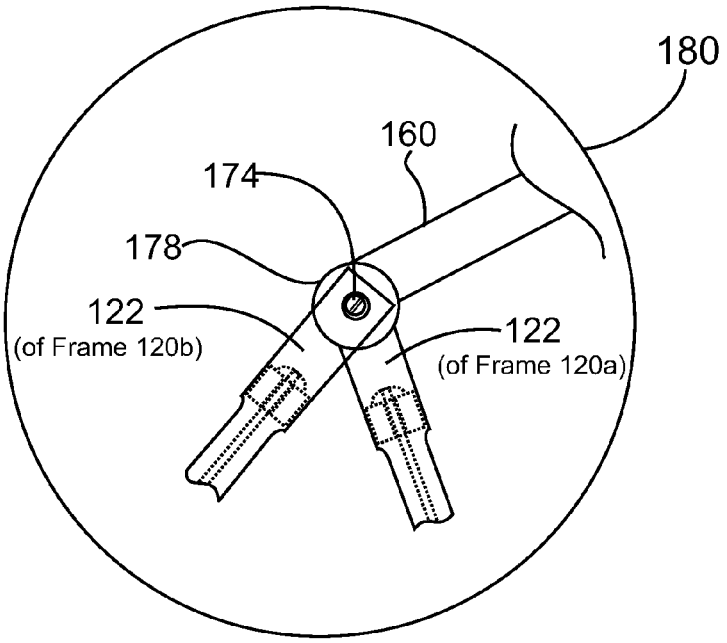
FIG. 8B is a detailed perspective, schematic view of the frame connection region of the A-frame structure of FIG. 8A.

Referring now also to FIGS. 8A and 8B, there are shown a perspective, schematic view of U-shaped collapsible support frames assembled into an A-frame structure, and a detailed perspective, schematic view of the frame connection region of the A-frame structure of FIG. 8A, respectively.

The A-frame structure that results from rotatively interconnecting U-shaped, collapsible support frames 120*a*, 120*b* to one another forms the complete frame of the novel chair 100. The pivotable (i.e., rotative) interconnection of support frames 120*a*, 120*b* is shown schematically at reference numbers 180.

Referring now to FIG. 8B, there is shown a perspective, schematic view of the region 180 of FIG. 8A. Rotative interconnection of U-shaped, collapsible support framed 120*a*, 120*b* is accomplished by connecting corresponding flattened regions 124 of upper frame braces 122 of both frames 120*a*, 120*b* to respective ends of upper frame member 160.

To accomplish such interconnection, A machine screw 174 is placed into through hole 126 in flattened region of upper support brace associated with U-shaped, collapsible support frame 120*b*.

A nylon or polytetrafluoroethylene (PTFE) better known as Teflon® washer is placed onto the threads of machine screw 174. It will be recognized that materials other than polytetrafluoroethylene (PTFE) exist and are believed to be known to those of skill in the art from which a "slippery" washer may be formed. Consequently, the invention is not considered limited to the nylon or polytetrafluoroethylene (PTFE) materials chosen for purposes of disclosure. Rather, the invention is intended to include washers formed from any suitable other material.

Machine screw 174 is then passed through hole 126 in a corresponding upper frame brace associated with U-shape, collapsible support frame 122*a*. Finally, machine screw 174 is secured in threads 170 of plastic insert 162 in the associated end of upper frame member 160. This operation is performed on both sides of U-shaped, collapsible support frames 120*a*, 120*b*, thereby completely forming the A-frame structure shown in FIG. 8A.

It will be recognized that numerous mechanisms are known to those of skill in the art for pivotably interconnecting frames 120*a* and 120*b*. Such mechanisms include, but are not limited to, detented mechanisms capable of self-locking frames 120*a* and 120*b* in discrete, predetermined angular relationships to one another. Such mechanisms are neither discussed nor described in further detail herein.

Flexible straps 182, typically having one or more grommets 184 may be used to secure the angular relationship of frames 120A and 120*b*. Flexible straps 182 have each a proximal end rotatively connected to U-shaped, collapsible frame 120*a* and typically contain several grommets 184. Grommets 184 may be selectively placed over a screw or post 186 in one of the hollow tubular frame pieces 140. By selecting the particular grommet 184 in flexible straps 182, the angle formed between rotatively connected U-shaped, collapsible support frames 120*a*, 120*b* may be selected and maintained while chair 100 is in use.

Back supporting flexible straps 188 are attached to upper frame member 160 and lower frame member 148 of first U-shaped, collapsible frame 120*a*. At their upper ends, back supporting flexible straps encircle upper fame member 160 and the stitched together with stitching shown schematically at reference number 190.

At their lower ends, back supporting flexible straps utilize a hook-and-loop fastening material with a hook portion 192 and loop portion disposed on a first major surface of back supporting flexible straps 188 and a mating loop portion disposed on an opposing major surface of back-supporting straps 188. This arrangement allows back supporting flexible straps to be tightened once the angle, not specifically identified, between first U-shape rigid frame 120*a* and second U-shaped rigid frame 120*b* is established and maintained by straps 182.

Refer now again also to FIGS. 3, 6, 7, and 8. In operation, compactable, collapsible chair 100 may be transformed from an operational configuration to a collapsed configuration by first unfastening straps 182.

If the chair 100 configuration includes an inflatable bladder 116 (FIG. 2*b*), it may be necessary to deflate inflatable bladder 116 prior to unfastening straps 182.

Corresponding frame hollow members 140 of frames 120*a* and 120*b* may be pushed inwardly (toward the center of respective frames 120*a* and 120*b*) until the frames are totally collapsed.

Once collapsed, the compacted structure may be rolled up in the moisture proof barrier 110 (FIGS. 2*a*, 2*b*) into a configuration suitable for carrying in a backpack or other such container.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A collapsible, compactable chair comprising:

a) a first and a second collapsible, substantially U-shaped frame, each comprising:

i) a U-shaped bottom member having a major axis, said U-shaped bottom member having a first end and a second opposing end, both substantially orthogonal to said major axis, ii) a collapsible right side comprising: an upper frame brace having a flattened top region with a hole disposed therethrough and a reduced diameter lower region; and, at least two self-aligning hollow tubular frame members, each having a top and a reduced diameter lower region, said reduced diameter lower region of said upper frame brace being inserted into and frictionally engaging said top of a first of said at least two hollow tubular frame members, said reduced lower region of said first of said at least two hollow tubular frame members being inserted into and frictionally engaging said top of a second of said at least two hollow tubular frame members, said reduced diameter lower region of said second of said at least two hollow tubular frame members being inserted into and frictionally engaging said first end of said U-shaped bottom member;

iii) a collapsible left side comprising: an upper frame brace having a flattened top region with a hole disposed therethrough and a reduced diameter lower region; and, at least two self-aligning hollow tubular frame members, each having a top and a reduced diameter lower region, said reduced diameter lower region of said upper frame brace being inserted into and frictionally engaging said top of a first of said at least two hollow tubular frame members, said reduced lower region of said first of said at least two hollow tubular frame members being inserted into and frictionally engaging said top of a second of said at least two hollow tubular frame members, said reduced diameter lower region of said second of said at least two hollow tubular frame members being inserted into and frictionally engaging said second, opposing end of said U-shaped bottom member;

iv) a single elastic band passing through said at least two hollow tubular frame members of said left collapsible side, said bottom member, and said at least two hollow tubular frame members of said right collapsible side, said single elastic band having a first end affixed to said upper frame brace of said left collapsible side and a second end affixed to said upper frame brace of said right collapsible side;

b) a top frame member having a first end rotatively connected to said flattened upper regions of said upper frame brace members of said left collapsible side of each of said first and said second rigid, substantially U-shaped frames and having a second, opposing end and rotatively connected to said flattened upper regions of said upper frame brace members of said right collapsible side of each of said first and said second rigid, substantially U-shaped frames; and c) a membrane having a water-resistant, ground engaging lower surface and a wear resistant upper surface attached to said top member and covering at least said first collapsible, substantially U-shaped frame, said membrane extending outwardly beyond said bottom member of said first collapsible, substantially U-shaped frame.

2. The collapsible, compactable chair as recited in claim 1, further comprising:

d) a flexible strap having a plurality of spaced-apart grommets along a major axis thereof; and e) at least one grommet-engaging pin disposed in each of said first and said second collapsible, substantially U-shaped frames;

whereby an angle of said first collapsible, substantially U-shaped frame relative to said second collapsible, substantially U-shaped frame may be established and maintained by selectively engaging ones of said plurality of grommets for engagement with said at least one grommet-engaging pin disposed in each of said first and said second collapsible, substantially U-shaped frames, thereby creating an A-frame structure.

3. The collapsible, compactable chair as recited in claim 1, further comprising:

d) at least one strap having a first end attached to said top frame member and a second end having a first portion of a hook-and-loop fastening system disposed on a first major surface proximate said second end, said first portion of a hook-and-loop fastening system being selectively engaged by a second, mating portion of a hook-and-loop fastening system disposed on a second major surface of said at least one strap after said at least one strap encircles said bottom frame member of said first collapsible, substantially U-shaped frame.

4. The collapsible, compactable chair as recited in claim 1 wherein said upper frame braces, said hollow, tubular frame members, said bottom frame member, and said top frame member are formed from a light-weight, ductile metal.

5. The collapsible, compactable chair as recited in claim 4 wherein said light-weight, ductile metal comprises aluminum.

* * * * *